United States Patent [19]

Blaine, deceased et al.

[11] 4,046,669

[45] Sept. 6, 1977

[54] SOLVENT EXTRACTION OF OIL FROM TAR SANDS UTILIZING A TRICHLOROETHYLENE SOLVENT

[76] Inventors: Neal Franklin Blaine, deceased, late of Lomita, Calif.; Geneva Blaine, executrix, 26007 S. Lucille Ave., Lomita, Calif. 90717

[21] Appl. No.: 650,165

[22] Filed: Jan. 19, 1976

Related U.S. Application Data

[63] Continuation of Ser. No. 537,654, Dec. 31, 1974, abandoned.

[51] Int. Cl.[2] ..... C10G 1/04
[52] U.S. Cl. ..... 208/11 LE
[58] Field of Search ..... 208/11 LE

[56] References Cited

U.S. PATENT DOCUMENTS

| | | | |
|---|---|---|---|
| 2,173,842 | 9/1939 | Horner | 208/11 LE |
| 2,453,633 | 11/1948 | Logan | 208/11 LE |
| 3,392,105 | 7/1968 | Poettmann et al. | 208/11 LE |
| 3,941,679 | 3/1976 | Smith et al. | 208/11 LE |

OTHER PUBLICATIONS

Hawley, G. G. ed. Condensed Chemical Dictionary 8th ed. Van Nostrand Reinhold Co., N.Y. pp. 886, 364, 927, 668.

*Primary Examiner*—Delbert E. Gantz
*Assistant Examiner*—James W. Hellwege

[57] ABSTRACT

Oil is efficiently solvent extracted from tar sands utilizing a trichloroethylene solvent at mild conditions. The process preferably utilizes minor amounts of surfactant and polyelectrolytes. The process has resulted in unexpectedly high yields of oil with unexpectedly low solvent loss.

2 Claims, No Drawings

SOLVENT EXTRACTION OF OIL FROM TAR SANDS UTILIZING A TRICHLOROETHYLENE SOLVENT

RELATED U.S. APPLICATION DATA

Continuation of Ser. No. 537,654 filed on Dec. 31, 1974 and now abandoned.

INTRODUCTION

The invention described herein relates to the recovery of tar from tar sands and is particularly concerned with an improved technique of solvent extracting tar of 6°-15° API from tar sands utilizing a trichloroethylene solvent at mild conditions.

Tar sands exist in various areas of this hemisphere and large quantities of tar sands have been discovered in Alberta, Canada which are known as the athabasta Tar Sands. Large amounts of tar for petroleum processing are contained within and about the sand particles of the tar sands. The amount of tar in the tar sand varies from about 5 to 30 volume percent, a typical tar sand contains approximately 18 percent tar. The gravity of the tar (heavy crude oil) after it is extracted from the tar sands ranges generally from 4° to 14° API, a typical gravity being 11° API. Such tar can be readily processed utilizing the advanced refinery techniques such as coking and the other conventional cracking operations. The tar sands are located 100 to 500 feet below overburdens in beds that vary in their thickness.

The existance of tar sands have been known for many years, however, the high costs of obtaining and processing the tar sands has heretofore been economically prohibitive. In today's energy lacking environment, however, the recovery of tar from tar sands is now economically attractive because of the present high prices of crude oil for refinery processing and the lowering of supply of crude oil.

Solvent extraction of tar from tar sands has been known, however, the low yields of tar and high energy consumption and loss of solvent has made such processes generally unfavorable. The discovery of a suitable solvent for recovery of high yields of tar from the tar sands with low loss of the relatively expensive solvent would greatly improve the oil production process.

THE INVENTION

One purpose of the invention is to develop an efficient solvent extraction process for high yields of tar from tar sands with low solvent and energy consumption. Another object of the invention is to develop a solvent extraction process utilizing relatively mild conditions. Other and further objects of the invention will be apparent from the following discussion.

The essence of the invention consists of the utilization of trichloroethylene as a solvent in a solvent extraction process for removing tar from the sand particles of tar sands. The process is conducted at relatively mild conditions of from about 70° F. to 800° F. and 0 to 200 psig. It is preferred that temperatures of 70° F. to 500° F., and pressures of 0-80 psig be utilized. A typical process utilizes a temperature of about 300° F. and pressures of 50 psig. The amount of solvent utilized is dependent principally on the size of the contact vessel, process conditions and percentage of tar in the sand. Generally the amount of solvent transferred to the contact vessel is from three times to ten times the amount of tar on a weight basis. A typical weight ratio of gross solvent transferred to the contact vessel to the amount of tar in the tar sands is five to one and ratios of three to one to seven to one are common. It should be understood, however, that the amount of make-up solvent compared to the amount of tar is minimal i.e. less than 5 percent, generally less than 2 percent, and the solvent loss any higher than the above is due to equipment or other mechanical failures. It should be understood, that the exact process conditions, solvent to tar ratios, and equipment sizing are such that can be readily ascertained by those skilled in the art with a minimal amount of experimentation and that the exact process conditions are not the essence of this invention.

It is contemplated, but is not necessary to the operation of this invention, that certain surfactants in the amount of about 1-20 parts per million are utilized in the solvent to reduce surface tension and film strength between the tar and sand particles. In addition, polyelectrolytes can be employed in amounts of 1-20 parts per million to relieve any problems from fine particle electric charges.

The use of the solvent herein, particularly trichloroethylene, has been found to result in unexpectedly higher tar yields and lower solvent loss. Tar yields of over 99 volume percent recoverable from tar sands have been found by the use of the solvent herein, particularly trichloroethylene. Generally, solvent losses are less than 0.5 volume percent. Prior art solvents have resulted in much less efficient operation. No particular theory can be competently offered to account for this greatly improved process since the improved yields and lows solvent loss were not expected from any theoretical evaluation of the solvent. All that can be offered is that the particular solvent of this invention has uniquely efficiently removed the tar from the tar sand particles. It can be speculated that the unsaturated group in combination with the chloro group interferes with the attractive forces acting between the tar particles and the sand particles, thus improving the process of solvent extraction. The solvent described herein has given greatly and unexpected improved results over prior art solvents such as hextance benzene and toluene.

The solvent of this invention has the following chemical structure:

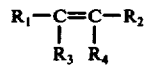

Wherein, $R_1$, $R_2$ $R_3$ and $R_4$ are the same or different hydrogen or chloro.

Accordingly, the solvent of this invention is monochloroethylene, dichloroethylene, trichloroethylene or tetrachloroethylene.

The preferred solvents of the invention are trichloroethylene and tetrachloroethylene. The most preferred solvent is trichloroethylene.

One advantage of the solvents of the invention is that they have a low specific heat and a low latent heat of vaporization so that the energy requirements for the process for the continued heating and cooling of the solvent in the solvent extraction process is low. The solvent can be, but not necessarily is, provided in diluted forms with inert oils as is known in the art.

The process is generally preferred to be continuous as in most modern and industrial processes, however, batch processes and seim-continuous processes can be utilized. Generally it is preferable that gross amounts of tar sands be separated from the tar by known mechanical processes, however, such is not necessary to the operation of this invention.

While applicant does not intend to be bounds by any particular mechanical process equipment utilized to contact the solvent of this invention with the tar sands or with the particular process methods employed, to recover and recycle the solvent, the tar sand, which may have been previously crushed into 4-inch lumps or less is fed from a hopper into the top of a solvent extraction contactor vessel. Mechanical separation processes may be, but not necessarily are, utilized to separate gross sand from tar upstream of the extraction vessel. The solvent is then fed into the lower side or end of the contact vessel for mixing with the tar sands. Contact vessels known in the art with bubble caps, trays, rings, or staged contact areas can be utilized as is known in the art.

The solvent of the invention breaks up the tar sand lumps into smaller particles resulting in progressively greater contact surface area with the original lumps of solid matter becoming loose and the tar is taken up in solution by the solvent. More efficient contact is achieved with the solvent of this invention because the density of the solvent and bulk density of the tar sand particles are substantially the same.

Recycle solvent is injected in the bottom of the contact vessel. The contact vessel may be pressured with nitrogen depending on the particular process conditions desired. Heating oil is circulated through an external heater to control any process temperatures. Solvent vapor is removed from the top of the column, condensed and recycled to a make-up solvent vessel for further recycle to the contactor vessel. Because of the mild process conditions utilized, solvent loss is below 0.5 volume percent and energy requirements to condense the solvent are minimal. The tar sand contacts the solvent within the contactor vessel and flows to the bottom of the vessel. Relatively clean sand is removed from the bottom of the vessel, with such removal rate being controlled by a sand level controller. The sand which settles at the bottom of the contactor may be re-contacted with smaller amounts of the solvent until the sand is relatively free of tar. The clean sand is sent to storage. As has been stated, it has been found that the clean sand contains less than 0.35 volume percent tar, thereby resulting in substantial yields of oil from the initial tar sand which typically contains 17.5 percent oil.

The removed oil having a typical gravity of 10°-12° API is removed from the side of the vessel and may be heated, and transferred to a distillation column for separating light ends from heavy ends of the oil for further processing. Some distillation and refinery operations may be desired at the site of the solvent extraction process which may be close to the tar sand fields for improving transportation costs.

Various types of solvent extraction vessels can be utilized with either packed or bubble cap columns being utilized. Such mechanical and engineering features are not part of the essence of the invention herein, the invention being defined by the following claims:

I claim:

1. In an oil solvent extraction process wherein a tar sand is contacted with a solvent at mild conditions of temperatures from 70° F. to about 800° F. and pressures from 0 to about 200 psig, the improvement wherein said solvent is trichloroethylene and wherein said solvent is contacted with said tar sand in a contact vessel; wherein the solvent and tar is removed from the upper portion of such vessel; wherein the sand is removed from the lower portion of such vessel and wherein the solvent is removed from the extracted tar for further use in the solvent extraction process.

2. The process of claim 1 wherein the process is conducted at mild conditions of from 70° F. to 500° F. and pressures of 0 to 80 psig.

* * * * *